United States Patent [19]

Maurer et al.

[11] Patent Number: 4,629,521

[45] Date of Patent: Dec. 16, 1986

[54] NICKEL BASE ALLOY

[75] Inventors: Gernant E. Maurer, New Hartford; William J. Boesch, Utica, both of N.Y.; Jean M. Theret, Versailles, France

[73] Assignees: Special Metals Corporation, New Hartford, N.Y.; Societe National d'Etude et de Construction de Moteurs d'Aviation, Paris, France

[21] Appl. No.: 679,725

[22] Filed: Dec. 10, 1984

[51] Int. Cl.[4] ..... C22C 19/05

[52] U.S. Cl. ..... 148/410; 148/428

[58] Field of Search ..... 420/443, 448; 148/410, 148/428

[56] References Cited

U.S. PATENT DOCUMENTS

| | | | |
|---|---|---|---|
| 2,515,185 | 7/1950 | Bieber et al. | 75/170 |
| 2,570,193 | 10/1951 | Bieber et al. | 75/171 |
| 2,793,108 | 5/1957 | Franklin | 75/0.5 |
| 2,809,110 | 10/1957 | Darmara | 75/171 |
| 2,975,051 | 3/1961 | Wilson et al. | 75/171 |
| 3,093,476 | 6/1963 | Gittus | 75/171 |
| 3,164,465 | 1/1965 | Thielemann | 75/171 |
| 3,260,505 | 7/1966 | Snyder | 253/77 |
| 3,561,955 | 2/1971 | Wheaton | 75/171 |
| 3,677,747 | 7/1972 | Lund et al. | 75/171 |
| 3,869,284 | 3/1975 | Baldwin | 75/134 F |
| 3,890,816 | 6/1975 | Allen et al. | 75/0.5 BA |
| 3,941,590 | 3/1976 | Watanabe | 75/171 |
| 3,976,480 | 8/1976 | Rikizo | 75/171 |
| 4,039,330 | 8/1977 | Shaw | 75/171 |
| 4,078,951 | 3/1978 | Denzine et al. | 148/32.5 |
| 4,083,734 | 4/1978 | Boesch | 148/32.5 |
| 4,093,476 | 6/1978 | Boesch | 148/32.5 |
| 4,140,555 | 2/1979 | Garcia et al. | 148/32 |

*Primary Examiner*—R. Dean

*Attorney, Agent, or Firm*—Robert F. Dropkin

[57] ABSTRACT

A gamma prime strengthened nickel-base alloy characterized by a highly desirable combination of stress rupture life, hot corrosion resistance, oxidation resistance, phase stability and ductility. The alloy contains from 14 to 18% chromium, from 0.3 to 3% molybdenum, from 4 to 8% tungsten, from 0.01 to 1.0% vanadium, from 3.5 to 5.5% aluminum, from 1 to 4% titanium, from 3 to 7% cobalt, from 0.01 to 0.05% carbon and from 0.035 to 0.1% boron.

17 Claims, No Drawings

NICKEL BASE ALLOY

The present invention relates to a gamma prime strengthened nickel-base alloy.

Cobalt, one of the elements typically found in superalloys, is and has been of great concern to superalloy producers. It is a so-called strategic element which has been in short supply and one which very well might be in short supply again. Yet it has been, and is, added to nickel-base superalloys for a variety of reasons, including solid solution strengthening, phase stability, ductility enhancement and hot corrosion resistance.

Through the present invention there is provided a nickel-base superalloy with a cobalt level which is lower than that typically found in superalloys. A careful selection and balancing of elements has allowed for an alloy having a lower cobalt content. Judiciously selected levels of chromium, molybdenum, tungsten, vanadium, aluminum, titanium, carbon and boron are present.

The alloy of the present invention is characterized by a highly desirable combination of stress rupture life, hot corrosion resistance, oxidation resistance, phase stability and ductility. It is particularly useful for cast articles such as turbine blades and vanes.

Nickel-base superalloys are described in a number of references. These references include the following United States patents and patent applications:

U.S. Pat. No. 2,515,185
U.S. Pat. No. 2,570,193
U.S. Pat. No. 2,793,108
U.S. Pat. No. 2,809,110
U.S. Pat. No. 2,975,051
U.S. Pat. No. 3,093,476
U.S. Pat. No. 3,164,465
U.S. Pat. No. 3,260,505
U.S. Pat. No. 3,561,955
U.S. Pat. No. 3,677,747
U.S. Pat. No. 3,890,816
U.S. Pat. No. 3,941,590
U.S. Pat. No. 3,976,480
U.S. Pat. No. 4,039,330
U.S. Pat. No. 4,078,951
U.S. Pat. No. 4,083,734
U.S. Pat. No. 4,093,476
U.S. Pat. No. 4,140,555
U.S. Pat. No. Re. 29,920
U.S. Ser. No. 270,745 (6/12/81)

None of the references disclose the alloy of the present invention. They do not disclose the very specific and significant ranges imposed upon the alloy of the present invention.

It is accordingly an object of the present invention to provide a low cobalt gamma prime strengthened nickel-base alloy.

The alloy of the present invention consists essentially of, by weight, from 14 to 18% chromium, from 0.3 to 3.0% molybdenum, from 4 to 8% tungsten, from 0.01 to 1.0% vanadium, up to 0.05% tantalum, up to 0.05% columbium, from 3.5 to 5.5% aluminum, from 1 to 4% titanium, from 3 to 7% cobalt, up to 2% iron, from 0.01 to 0.05% carbon, from 0.035 to 0.1% boron, up to 0.1% zirconium, up to 0.01% nitrogen, up to 0.5% copper, up to 0.12% manganese, up to 3% of elements from the group consisting of rhenium and ruthenium, up to 0.2% of rare earth elements that will not lower the incipient melting temperature below the solvus temperature of the gamma prime present in the alloy, up to 0.15% of elements from the group consisting of magnesium, calcium, strontium and barium, up to 0.1% hafnium, balance essentially nickel. Exemplary rare earth elements are cerium and lanthanum.

Elements forming the alloy of the present invention must be balanced so as to provide a stable alloy; i.e., an alloy which is substantially free of sigma and other undesirable TCP (Topologically Close-Packed) phases. The alloy of the present invention, accordingly, has an $\overline{M}d$ value at or below 0.97. The $\overline{M}d$ value is preferably at or below 0.967.

The $\overline{M}d$ value for the alloy of the present invention is calculated in accordance with the following equation:

$$\overline{M}d = \sum_{i=1}^{n} Mi\,(\overline{M}d)_i$$

where: Mi is the atomic fraction of element i in the gamma matrix; $(\overline{M}d)_i$ is the parameter representing an average energy level of d orbitals of the alloying element i; and n is the number of elements in the gamma matrix. Substituting the $(\overline{M}d)_i$ numbers for the particular elements gives:

$$\overline{M}d = 0.717(M_{Ni}) + 0.777(M_{Co}) + 2.271(M_{Ti}) + 1.900(M_{Al}) + 1.655(M_W) + 1.550(M_{Mo}) + 1.142(M_{Cr}) + 1.543(M_V) + 2.944(M_{Zr})$$

The following assumptions are used to determine the amounts of the elements in the borides, carbides and gamma phases:

(a) Assume 70% of the boron atoms combine to form a boride of the following stoichiometry: $(Cr_{0.72}W_{0.11}Mo_{0.11}Ti_{0.02}V_{0.02}Ni_{0.02})B_2$. Deplete the matrix according to the amount of each element consumed.

(b) Assume 30% of the boron atoms combine to form a boride of the following stoichiometry: $(Cr_{0.87}W_{0.07}Mo_{0.06})_{23}(B,C)_6$, where (B,C) equals the sum of the remaining boron and all available carbon. Deplete the matrix according to the amount of each element consumed.

(c) The partition ratios below are used to calculate how the elements partition to the gamma phase.

Aluminum $R_{Al}=0.727P_{Al}$
Titanium $R_{Ti}=0.412P_{Ti}$
Chromium $R_{Cr}=1.619P_{Cr}$
Tungsten $R_W=0.484P_W$
Cobalt $R_{Co}=1.487P_{Co}$
Zirconium $R_{Zr}=1.818P_{Zr}$
Molybdenum $R_{Mo}=1.818P_{Mo}$
Vanadium $R_V=1.818P_V$
Nickel $R_{Ni}=0.863P_{Ni}$ Where:

$R_i$=the amount of element i in the gamma phase,
$P_i$=the amount of element i in the alloy after the borides form.

To calculate the atomic percent of the elements (Mi) in the gamma phase, the equation below is used for each element:

$$Mi = \frac{Ri}{\Sigma R_i}$$

Chromium is present in an amount of from 14 to 18%. At least 14% is present for corrosion protection. The alloy tends to become unstable at levels in excess of 18%. A preferred chromium content is from 15 to 17%.

Molybdenum is present in an amount of from 0.3 to 3.0%. A preferred molybdenum content is from 0.8 to 1.8%. Molybdenum is added as it is a solid solution strengthener. Too much molybdenum can be disadvantageous. Excessive molybdenum will tend to prevent the formation of a good tenacious oxide and will, in turn, decrease corrosion resistance. Molybdenum can, however, be beneficial to corrosion resistance at levels below 3%.

Tungsten is present in an amount of from 4 to 8%. Like molybdenum, it is a solid solution strengthener. Too much tungsten can be disadvantageous for the same reasons too much molybdenum can be disadvantageous. Tungsten additions are, however, additionally advantageous in that they tend to give the alloy more uniform properties. Tungsten tends to segregate into the dendritic core areas of the alloy, whereas molybdenum tends to segregate into the interdendritic areas of the alloy. A preferred tungsten content is from 5 to 7%.

Vanadium is present in an amount of from 0.01 to 1.0%. A preferred vanadium content is from 0.3 to 0.7%. Vanadium improves the stress rupture life of the alloy. Too much vanadium can be detrimental to the hot corrosion and oxidation resistance of the alloy as well as its phase stability.

A maximum limit of 0.05% is placed upon tantalum and columbium. Higher amounts of tantalum or columbium tend to promote the formation of undesirable TCP phases. These elements also form large stable carbides which cannot be effectively altered by heat treatment. The large carbides act as sits which can initiate fatigue cracks.

Aluminum is present in an amount of from 3.5 to 5.5%. Aluminum forms gamma prime, the alloy's basic strengthening mechanism. It is also necessary for adequate oxidation resistance. Too much aluminum is accompanied by the formation of excessive eutectic gamma prime, which tends to adversely affect the strength of the alloy. A preferred aluminum content is from 4 to 5%.

Titanium is present in an amount of from 1 to 4%. Like aluminum, titanium forms gamma prime. Titanium also enhances the alloy's hot corrosion resistance. It is usually present in an amount of from 1.3 to 3.7%. With too much titanium, eta ($Ni_3Ti$) phase tends to form. Eta phase decreases the ductility of the alloy. A preferred titanium content is from 1.5 to 2.5%.

Cobalt is present in an amount of from 3 to 7%. At least 3% is present for its strengthening effect. The alloy tends to become structurally unstable at levels in excess of 7%. A preferred cobalt content is from 4 to 6%.

A maximum limit of 2% is placed upon iron. Iron tends to adversely affect the elevated temperature mechanical properties of the alloy. The maximum iron content is preferably 0.5%.

Carbon and boron are respectively present in amounts of from 0.01 to 0.05% and 0.035 to 0.1%. Together, they form carbo-borides and borides. Alloys with the best combination of stress rupture life and ductility have the specified boron and carbon contents and a boron content greater than the carbon content. Strength falls off at 1650° F., with too much carbon. Too much boron results in the formation of too many grain boundary borides which, in turn, adversely affect ductility and strength. A preferred carbon content is from 0.02 to 0.04%. A preferred boron content is from 0.06 to 0.09%.

Up to 0.1% zirconium may be added to the alloy as zirconium is a grain boundary strengthener and desulfurizer. Higher amounts of zirconium are not added as zirconium tends to form a deleterious $Ni_5Zr$ grain boundary phase which contributes to alloy embrittlement. Zirconium is generally present in amounts of at least 0.015%.

A maximum of 0.01% is placed upon nitrogen. Nitrogen tends to form titanium nitrides and other detrimental nitrides. These nitrides act as sites which can initiate fatigue cracks.

Various other elements may be added to the alloy up to the limits set forth hereinabove. The maximum amount of elements from the group consisting of magnesium, calcium, strontium and barium is usually 0.05%. Hafnium is usually present in amounts of 0.05% or less as it tends to form hafnium carbides which are not heat treatable.

The following examples are illustrative of several aspects of the invention:

EXAMPLE I

Two alloys (Alloys A and B) were prepared using standard vacuum induction melting practices. The chemistry of the alloys appears hereinbelow in Table I.

TABLE I

| Alloy | Composition (wt. %) | | | | | | | | | | |
|---|---|---|---|---|---|---|---|---|---|---|---|
| | Cr | Co | Mo | W | V | Ti | Al | C | B | Zr | Ni |
| A. | 16.0 | 5.0 | 2.0 | 7.0 | — | 3.5 | 3.5 | 0.015 | 0.09 | 0.05 | Bal. |
| B. | 16.2 | 5.0 | 2.0 | 7.0 | 0.5 | 3.5 | 3.5 | 0.037 | 0.09 | 0.06 | Bal. |

Alloy B has a vanadium content within the limits of the present invention whereas Alloy A does not. Alloy A is devoid of vanadium.

The alloys were investment cast, heat treated as follows:

2125° F. (1163° C.)—2 Hours—Air Cooled

1700° F. (927° C.)—16 Hours—Air Cooled and tested for stress rupture life under the following conditions:

1800° F. (982° C.)/22 ksi (152 MPa)

1400° F. (760° C.)/90 ksi (620 MPa)

The results of the tests appear hereinbelow in Table II.

TABLE II

| Alloy | Stress Rupture Life (Hours) | |
|---|---|---|
| | 1800° F./22 ksi | 1400° F./90 ksi |
| A. | 93.6 | 203.1 |
| B. | 119.7 | 242.7 |

The beneficial effect of vanadium on the alloy of the present invention is readily clear from Table II. The stress rupture life for Alloy B, the vanadium-containing alloy, is significantly higher than that for Alloy A, the vanadium-free alloy, under both testing conditions.

The respective $\overline{M}d$ values for alloys A and B are 0.961 and 0.968. A study of the microstructures of both of these alloys did, however, reveal that they are unstable, despite the fact that alloys with an $\overline{M}d$ of or below 0.97 are generally within the present invention. The $\overline{M}d$ value for Alloy A is inconsistent with the bulk of the data. That for Alloy B is within a somewhat cloudy area. The $\overline{M}d$ for the present invention is preferably at or below 0.967.

The $\overline{M}d$ values for Alloys A and B show the effect of vanadium thereon. Alloy B, the vanadium-containing alloy, has a higher $\overline{M}d$ value than does Alloy A, the vanadium-free alloy. The vanadium content of alloys within the present invention must, accordingly, be carefully controlled. The present invention calls for a maximum vanadium content of 1.0% and a preferred maximum of 0.7%.

EXAMPLE II

Two additional alloys (Alloys C and D) were prepared using standard vacuum induction melting practices. The chemistry of these alloys appears hereinbelow in Table III:

TABLE III

| | Composition (wt. %) | | | | | | | | | | |
|---|---|---|---|---|---|---|---|---|---|---|---|
| Alloy | Cr | Co | Mo | W | V | Ti | Al | C | B | Zr | Ni |
| C. | 16.3 | 0.005 | 2.99 | 4.1 | — | 3.6 | 3.5 | 0.026 | 0.08 | 0.05 | Bal. |
| D. | 16.2 | 5.0 | 3.03 | 4.1 | — | 3.6 | 3.5 | 0.030 | 0.07 | 0.05 | Bal. |

Alloy D has a cobalt content within the limits of the present invention. Alloy C is essentially devoid of cobalt.

The alloys were investment cast, heat treated as follows:

2125° F. (1163° C.)—2 Hours—Air Cooled
1700° F. (927° C.)—16 Hours—Air Cooled and tested for stress rupture life under the following conditions:

1800° F. (982° C.)/22 ksi (152 MPa)
1400° F. (760° C.)/90 ksi (620 MPa)

The results of the tests appear hereinbelow in Table IV.

TABLE IV

| | Stress Rupture Life (Hours) | |
|---|---|---|
| Alloy | 1800° F./22 ksi | 1400° F./90 ksi |
| C. | 50.8 | 53.9 |
| D. | 77.3 | 128.6 |

The beneficial affect of cobalt on the alloy of the present invention is readily clear from Table IV. The stress rupture life for Alloy D, the cobalt-containing alloy, is significantly higher than that for Alloy C, the cobalt-free alloy, under both testing conditions.

The respective $\overline{M}d$ values for alloys C and D are 0.966 and 0.963. The microstructures of both of these alloys were studied and found to be stable. Alloys within the present invention have an $\overline{M}d$ value of or below 0.970.

EXAMPLE III

Five additional alloys (Alloys E, F, G, H, and I) were prepared using standard vacuum induction melting practices. The chemistry of these alloys appears herein below in Table V.

TABLE V

| | Composition (wt. %) | | | | | | | | | | |
|---|---|---|---|---|---|---|---|---|---|---|---|
| Alloy | Cr | Co | Mo | W | V | Ti | Al | C | B | Zr | Ni |
| E. | 15.7 | 5.0 | 1.53 | 5.87 | — | 3.6 | 3.56 | 0.081 | 0.025 | 0.068 | Bal. |
| F. | 15.7 | 5.0 | 1.54 | 5.85 | — | 3.6 | 3.53 | 0.021 | 0.018 | 0.063 | Bal. |
| G. | 15.7 | 5.0 | 1.56 | 6.02 | — | 3.6 | 3.51 | 0.073 | 0.093 | 0.077 | Bal. |
| H. | 15.7 | 5.0 | 1.55 | 5.91 | — | 3.6 | 3.48 | 0.025 | 0.078 | 0.059 | Bal. |
| I. | 15.6 | 5.0 | 1.54 | 5.90 | — | 3.7 | 3.56 | 0.017 | 0.059 | 0.065 | Bal. |

Alloys H and I have carbon and boron contents within the limits of the present invention. The carbon contents for Alloys E, F and G are excessive. Alloys E and G have more than 0.05% carbon. Alloy F has more carbon than boron. The boron contents for Alloys E and F are too low. They have less than 0.035% boron.

The alloys were investment cast, heat treated as follows:

2125° F. (1163° C.)—2 Hours—Air Cooled
1700° F. (927° C.)—16 Hours—Air Cooled and tested for stress rupture life and ductility under the following conditions:

1800° F. (982° C.)/22 ksi (152 MPa)
1400° F. (760° C.)/90 ksi (620 MPa)

The results of the tests appear hereinbelow in Table VI.

TABLE VI

| | 1800° F./22 ksi | | 1400° F./90 ksi | |
|---|---|---|---|---|
| Alloy | Life (Hrs.) | Elong. (%) | Life (Hrs.) | Elong. (%) |
| E. | 76.5 | 14.7 | 97.9 | 5.8 |
| F. | 62.8 | 4.4 | 36.7 | 3.5 |
| G. | 74.4 | 9.9 | 58.6 | 8.5 |
| H. | 82.1 | 14.9 | 89.9 | 8.2 |
| I. | 74.5 | 15.0 | 114.9 | 7.8 |

The beneficial affect of carbon and boron within the limits of the present invention is readily clear from Table VI. Alloys H and I exhibit the best condition of stress rupture life and ductility. Alloys H and I have carbon and boron contents within the limits of the present invention. The carbon and/or boron contents of the other alloys are outside these limits.

The $\overline{M}d$ values for alloys E, F, G, H and I are set forth hereinbelow in Table VII.

TABLE VII

| Alloy | $\overline{M}d$ |
|---|---|
| E. | 0.952 |
| F. | 0.955 |
| G. | 0.951 |
| H. | 0.953 |
| I. | 0.956 |

The microstructures of each of these alloys were studied and found to be stable. Alloys within the present invention have an $\overline{M}d$ value of or below 0.970.

EXAMPLE IV

An additional alloy (Alloy J) was prepared using standard vacuum induction melting practices. The chemistry of this alloy appears hereinbelow in Table VIII.

TABLE VIII

| Al- | Composition (wt. %) | | | | | | | | | | |
|---|---|---|---|---|---|---|---|---|---|---|---|
| loy | Cr | Co | Mo | W | V | Ti | Al | C | B | Zr | Ni |
| J. | 16.0 | 5.0 | 1.5 | 5.9 | 0.5 | 2.0 | 4.5 | 0.02 | 0.071 | 0.05 | Bal. |

The Md value for Alloy J is 0.964. The microstructure of Alloy J was studied and found to be stable.

Alloy J was investment cast, heat treated as follows:

2125° F. (1163° C.)—2 Hours—Air Cooled

1700° F. (927° C.)—16 Hours—Air Cooled and tested for stress rupture life and ductility under the following conditions:

1800° F. (982° C.)/22 ksi (152 MPa)

1400° F. (760° C.)/90 ksi (620 MPa)

The results of the tests appear hereinbelow in Table IX:

TABLE IX

| | 1800° F./22 ksi | | 1400° F./90 ksi | |
|---|---|---|---|---|
| Alloy | Life (Hrs.) | Elong. (%) | Life (Hrs.) | Elong. (%) |
| J. | 113.4 | 10.8 | 132.4 | 4.2 |

Table IX clearly shows that the alloy of the present invention has a highly desirable combination of stress rupture life and ductility.

Alloy J was subjected to a five-hundred hour oxidation test at a temperature of 1000° C. The test was cyclical in that the samples were cooled to room temperature and reheated once an hour. The results were very favorable. No change in weight was observed. The oxide depth was only 50 μm for one sample and 85 μm for a second sample.

EXAMPLE V

Two additional alloys (alloys K and L) were prepared using standard vacuum induction melting practices. The chemistry of these alloys appears hereinbelow in Table X:

TABLE X

| | Composition (wt. %) | | | | | | | | | | | |
|---|---|---|---|---|---|---|---|---|---|---|---|---|
| Alloy | Cr | Co | Mo | W | V | Ti | Al | Ta | C | B | Zr | Ni |
| K. | 16.1 | 4.9 | 1.6 | 5.9 | 0.5 | 3.0 | 4.0 | — | 0.024 | 0.072 | 0.05 | Bal. |
| L. | 16.1 | 4.9 | 1.6 | 5.9 | 0.5 | 3.0 | 4.0 | 0.5 | 0.027 | 0.071 | 0.05 | Bal. |

Alloy K is in accordance with the present invention whereas Alloy L is not. Alloy L is a tantalum-bearing alloy.

A study of the microstructure of Alloys K and L revealed that Alloy L was unstable. Alloy K was, on the other hand, found to be stable. Alloy K had an $\overline{M}d$ of 0.966. An $\overline{M}d$ value for Alloy L is not provided as the recited means for calculating $\overline{M}d$ does not take tantalum into account. Those skilled in the art will, however, realize that the $\overline{M}d$ value for Alloy L would clearly be in excess of 0.970.

EXAMPLE VI

Two additional alloys (Alloys M and N) were prepared using standard vacuum induction melting practices. The chemistry of these alloys appears hereinbelow in Table XI:

TABLE XI

| | Composition (wt. %) | | | | | | | | | | |
|---|---|---|---|---|---|---|---|---|---|---|---|
| Alloy | Cr | Co | Mo | W | V | Ti | Al | C | B | Zr | Ni |
| M. | 15.62 | 5.06 | 1.35 | 6.12 | 0.51 | 1.94 | 4.57 | 0.025 | 0.068 | 0.067 | Bal. |
| N. | 15.92 | 4.98 | 1.5 | 6.10 | 0.51 | 1.96 | 4.75 | 0.021 | 0.071 | 0.061 | Bal. |

Alloys M and N are in accordance with the present invention. The microstructures of both alloys were studied and found to be stable. Their respective $\overline{M}d$ values are 0.963 and 0.969.

Alloy M and N were investment cast, heat treated as follows:

2125° F. (1163° C.)—2 Hours—Air Cooled

1700° F. (927° C.)—16 Hours—Air Cooled and tested for hot corrosion resistance.

Samples of Alloys M and N were heated at a temperature of 850° C. in an atmosphere resulting from the burning of sulfur-bearing kerosene and air charged with sodium chloride, and cycled (cooled to room temperature and reheated) three times a day. This atmosphere is similar to that encountered by jet engines.

The results of the tests were very favorable in comparison to prior art alloys. Alloy M did not show signs of oxide spalling until 253 hours elapsed. Alloy N showed no signs of oxide spalling after 500 hours. Although it is now known for sure why alloy N performed better than Alloy M, the better performance can be attributed to the higher chromium content of Alloy N and to some extent its higher molybdenum content.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. A gamma prime strengthened nickel-base alloy consisting essentially of, by weight, from 14 to 18% chromium, from 0.3 to 3.0% molybdenum, from 4 to 8% tungsten, from 0.3 to 0.7% vanadium, up to 0.05% tantalum, up to 0.05% columbium, from 3.5 to 5.5% aluminum, from 1 to 4% titanium, from 3 to 7% cobalt, up to 2% iron, from 0.01 to 0.05% carbon, from 0.035 to 0.1% boron, up to 0.1% zirconium, up to 0.01% nitrogen, up to 0.5% copper, up to 0.12% manganese, up to 3% of elements from the group consisting of rhenium and ruthenium, up to 0.2% of rare earth elements that will now lower the incipient melting temperature below the solvus temperature of the gamma prime present in the alloy, up to 0.15% of elements from the group consisting of magnesium, calcium, strontium and barium, up to 0.1% hafnium, balance essentially nickel; said boron content being greater than said carbon content; said alloy being substantially free of sigma and other undesirable topologically close-packed phases; said alloy having an Md value at or below 0.967 calculated in accordance with the following equation:

$$\overline{M}d = 0.717(M_{Ni}) + 0.777(M_{Co}) + 2.271(M_{Ti}) + 1.900(M_{Al}) + 1.655(M_{W}) + 1.550(M_{Mo}) + 1.142(M_{Cr}) + 1.543(M_{V}) + 2.944(M_{Zr}).$$

2. A nickel-base alloy according to claim 1, having from 15 to 17% chromium.

3. A nickel-base alloy according to claim 1, having from 0.8 to 1.8% molybdenum.

4. A nickel-base alloy according to claim 1, having from 5 to 7% tungsten.

5. A nickel-base alloy according to claim 1, having from 4 to 5% aluminum.

6. A nickel-base alloy according to claim 1, having from 1.3 to 3.7% titanium.

7. A nickel-base alloy according to claim 6, having from 1.5 to 2.5% titanium.

8. A nickel-base alloy according to claim 1, having from 4 to 6% cobalt.

9. A nickel-base alloy according to claim 1, having up to 0.5% iron.

10. A nickel-base alloy according to claim 1, having from 0.02 to 0.04% carbon.

11. A nickel-base alloy according to claim 1, having from 0.06 to 0.09% boron.

12. A nickel-base alloy according to claim 11, having from 0.02 to 0.04% carbon.

13. A nickel-base alloy according to claim 1, having up to 0.1% copper.

14. A nickel-base alloy according to claim 1, having up to 0.05% of elements from the group consisting of magnesium, calcium, strontium and barium.

15. A nickel-base alloy according to claim 1, having up to 0.05% hafnium.

16. A nickel-base alloy according to claim 1, having at least 0.015% zirconium.

17. A gamma prime strengthened nickel-base alloy consisting essentially of, by weight, from 15 to 17% chromium, from 0.8 to 1.8% molybdenum, from 5 to 7% tungsten, from 0.3 to 0.7% vanadium, from 4 to 5% aluminum, from 1.3 to 3.7% titanium, from 4 to 6% cobalt, from 0.02 to 0.04% carbon, from 0.06 to 0.09% boron, from 0.015 to 0.1% zirconium, balance essentially nickel.

* * * * *

UNITED STATES PATENT AND TRADEMARK OFFICE

CERTIFICATE OF CORRECTION

PATENT NO. : 4,629,521

DATED : December 16, 1986

INVENTOR(S) : Gernant E. Maurer, William J. Boesch and Jean M. Theret

It is certified that error appears in the above-identified patent and that said Letters Patent are hereby corrected as shown below:

Column 8, line 68 insert --not-- in lieu of "now".

Signed and Sealed this

Thirty-first Day of March, 1987

*Attest:*

*Attesting Officer*

DONALD J. QUIGG

*Commissioner of Patents and Trademarks*